United States Patent [19]

Kobayashi et al.

[11] Patent Number: 4,621,985

[45] Date of Patent: Nov. 11, 1986

[54] HIGH VACUUM APPARATUS

[75] Inventors: Masao Kobayashi; Nobuyuki Ishida; Yoshihiro Toyoda, all of Neyagawa, Japan

[73] Assignee: Honjo Chemical Kabushiki Kaisha, Osaka, Japan

[21] Appl. No.: 631,107

[22] Filed: Jul. 16, 1984

[30] Foreign Application Priority Data

May 30, 1984 [JP] Japan ..... 59-111721

[51] Int. Cl.[4] ..... F04B 25/00

[52] U.S. Cl. ..... 417/250; 417/540

[58] Field of Search ..... 417/250, 244, 540, 543, 417/243; 156/345

[56] References Cited

U.S. PATENT DOCUMENTS

| | | | |
|---|---|---|---|
| 2,492,014 | 12/1949 | Spalding et al. | 417/540 |
| 2,891,717 | 6/1959 | Huitson | 417/250 |
| 3,027,651 | 4/1962 | Nerge | 417/243 |
| 3,059,396 | 10/1962 | Thees | 417/243 X |
| 3,116,872 | 1/1964 | Buechel et al. | 417/250 |
| 3,470,706 | 10/1969 | Mitchell et al. | 417/250 X |
| 4,371,412 | 2/1983 | Nishizawa | 156/345 |
| 4,401,507 | 8/1983 | Engle | 156/345 X |

FOREIGN PATENT DOCUMENTS

| | | | |
|---|---|---|---|
| 458571 | 12/1936 | United Kingdom | 417/250 |

*Primary Examiner*—Cornelius J. Husar
*Assistant Examiner*—Peter M. Cuomo
*Attorney, Agent, or Firm*—Wenderoth, Lind & Ponack

[57] ABSTRACT

A high vacuum apparatus which comprises:

a vacuum vessel, a mechanical booster connected to the vacuum vessel, a rotary pump connected to the mechanical booster, a gas inlet provided with a connecting pipe which connects the mechanical booster with the rotary pump, to introduce a gas into the suction side of the rotary pump so as to maintain the degree of vacuum in the suction side of the rotary pump lower than the maximum degree of vacuum attainable of the rotary pump, so that substantially no contamination of the atmosphere in the vacuum vessel by the reverse diffusing oil vapor occurs.

5 Claims, 9 Drawing Figures

HIGH VACUUM APPARATUS

The present invention relates to a high vacuum system, and more particularly to a high vacuum apparatus in which substantially no oil contamination occurs in a vacuum atmosphere in a vacuum vessel connected with a vacuum pump, and a method for attaining a high vacuum with substantially no oil contamination in the vacuum atmosphere.

High vacuum is very often required in the production of a wide variety of electronic elements and devices such as semiconductor integrated circuits. For example, a silicon substrate or wafer made therefrom is processed in a high vacuum vessel. In most cases, an oil rotary pump is connected with a vacuum vessel to attain therein a high vacuum. The maximum degree of vacuum attainable in the vacuum system using a rotary pump is usually $10^{-2}$ to $10^{-3}$ Torr. When a higher degree of vacuum is required, a vacuum system is formed as illustrated in FIG. 1, in which a vacuum vessel 1 is connected to an oil diffusion pump 3 which is in turn connected with a rotary pump 2 serving as an auxiliary pump. In this system the maximum degree of vacuum attainable is usually higher than $10^{-3}$ Torr. However, the vacuum pump oil is used in the vacuum pump reversibly diffuses into the vacuum vessel when the degree of vacuum therein reaches about $10^{-1}$ Torr or higher, and results in the contamination of the vacuum atmosphere therein with the oil vapor.

Therefore, in a conventional high vacuum system where the oil contamination of the atmosphere in a vacuum vessel should be avoided, a vacuum system is formed as illustrated in FIG. 2, which includes a cold trap 4 cooled, for example, at a liquid nitrogen temperature, is interposed between the vacuum vessel 1 and a diffusion pump 3 having an auxiliary rotary pump connected therewith. In this high vacuum system, since the reversibly diffusing oil vapor is trapped and condensed in the cold trap, the oil contamination of the vacuum atmosphere is prevented. However, the additional equipping of the cold trap makes the system complicated and the operation cost expensive, but also there may arise a difficulty in treating the condensed vapor in the trap depending on the atmosphere in the vacuum vessel.

For example, since silane gas which is flammable is often used as a vacuum atmosphere in the vacuum vessel for the production of semiconductor integrated circuits, the silane gas is trapped together with the oil vapor. Therefore, a further apparatus is necessary to recover the silane gas to secure the safety of the vacuum system.

FIG. 3 illustrates a flow sheet of a further high vacuum system wherein a mechanical booster 5 is incorporated therein which uses no vacuum pump oil. A vacuum vessel 1 has the mechanical booster and a rotary pump 2 connected therewith. The latter serves as an auxiliary pump. The oil contamination of the vacuum atmosphere is relatively small because of the use of the mechanical booster, however, the contamination is still greater than in the system shown in FIG. 1 wherein the cold trap is used.

The objective of the present invention is to obviate the above disadvantages involved in the prior high vacuum systems and to provide a high vacuum system in which substantially no reverse diffusion of vacuum pump oil into a vacuum vessel occurs without the use of a cold trap, and therefore to provide a high vacuum apparatus simple in construction and operation in which there arises substantially no contamination of the atmosphere in the vacuum vessel.

A further object of the invention is to provide a method for attaining a high vacuum in a vessel with substantially no oil vapor contamination of the atmosphere in the vaccum vessel.

The high vacuum apparatus of the invention comprises:

- a vacuum vessel,
- a mechanical booster connected with the vacuum vessel,
- a rotary pump connected with the mechanical booster,
- a gas inlet provided with a connecting pipe which connects the mechanical booster with the rotary pump, to introduce a gas into the suction side of the rotary pump so as to maintain the degree of vacuum in the suction side of the rotary pump lower than the maximum degree of vacuum attainable of the rotary pump.

The above and other advantages of the invention will become more apparent in the following description and the accompanying drawings in which.

Figure 1:
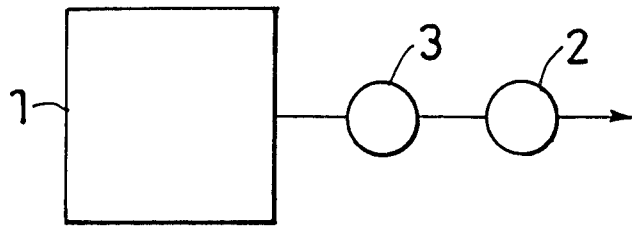
FIGS. 1-3 illustrate the prior art devices as described above.
Figure 2:
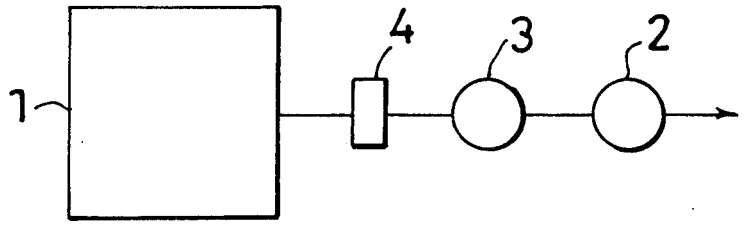
Figure 3:
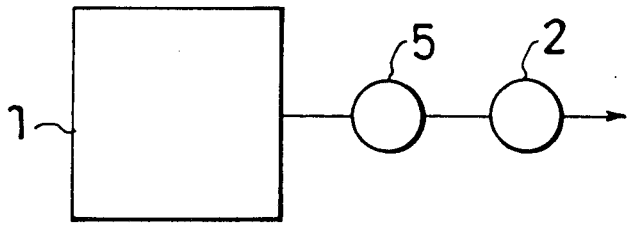
Figure 4:
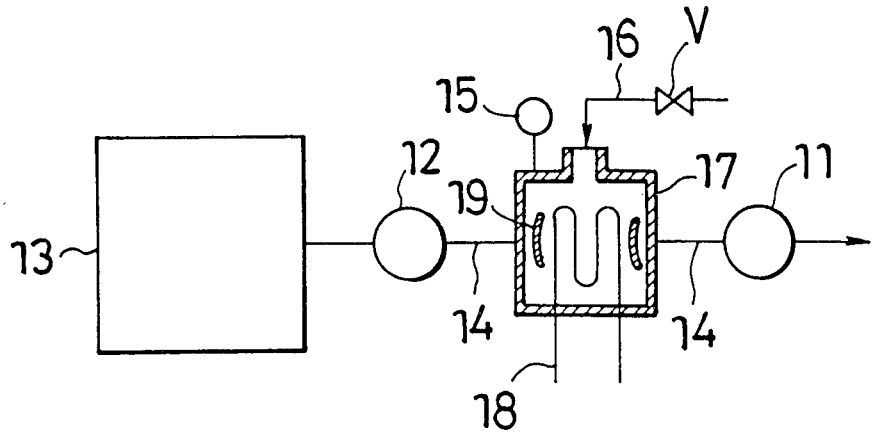
FIG. 4 illustrates an embodiment of a flow sheet of a high vacuum apparatus according to the present invention.

First referring to FIG. 4, a vacuum vessel 13 is connected to a mechanical booster 12 which is in turn connected with an oil rotary pump 11 serving as an auxiliary pump through a connecting pipe 14. A controlling chamber 17 is provided with the connecting pipe between the mechanical booster and the rotary pump. The controlling chamber has a vacuum gauge 15 to determine the degree of vacuum in the suction side or the upstream side of the rotary pump as well as a gas inlet 16 having a valve V to introduce a gas therethrough into the suction side of the rotary pump.

According to the high vacuum apparatus of the invention, it is essential that a gas is introduced into the controlling chamber through the gas inlet with a flow rate controllable by the valve V so as to maintain the degree of vacuum in the suction side or the upstream side of the rotary pump to be lower than the maximum degree of vacuum attainable of the rotary pump with measuring the degree of vacuum in the suction side of the rotary pump, and as a result, the reverse diffusion of oil vapor into the vacuum vessel, and hence the contamination of the atmosphere in the vacuum vessel 13 is prevented.

In general, since the maximum degree of vacuum attainable of a rotary pump is about $10^{-2}$–$10^{-3}$ Torr, although the degree being somewhat dependent on a rotary pump used, the suction side of the rotary pump is, for example, maintained at a vacuum of about $10^0$–$10^{-1}$ Torr. It is preferable that the degree of vacuum in the suction side of the rotary pump is 1/10 to 1/100 of the maximum degree of vacuum attainable of the rotary pump used.

The controlling chamber 17 may have a cooling water pipe 18 therein to cool and condense the oil vapor from the rotary pump, and also may have dampers 19 therein to prevent the reverse diffusion of oil vapor into the vacuum vessel, thereby to further diminish the contamination of the vacuum atmosphere in the vessel.

The gas for introducing into the suction side of the rotary pump is so selected as to give no harmful influence upon the vacuum atmosphere in the vessel and the vacuum apparatus. For example, inert gases such as nitrogen and argon are preferably used.

According to the high vacuum apparatus, substantially no contamination of the atmosphere in the vacuum vessel occurs, and the atmosphere is comparable with that in the vacuum system wherein a cold trap is incorporated therein.

Figure 5:
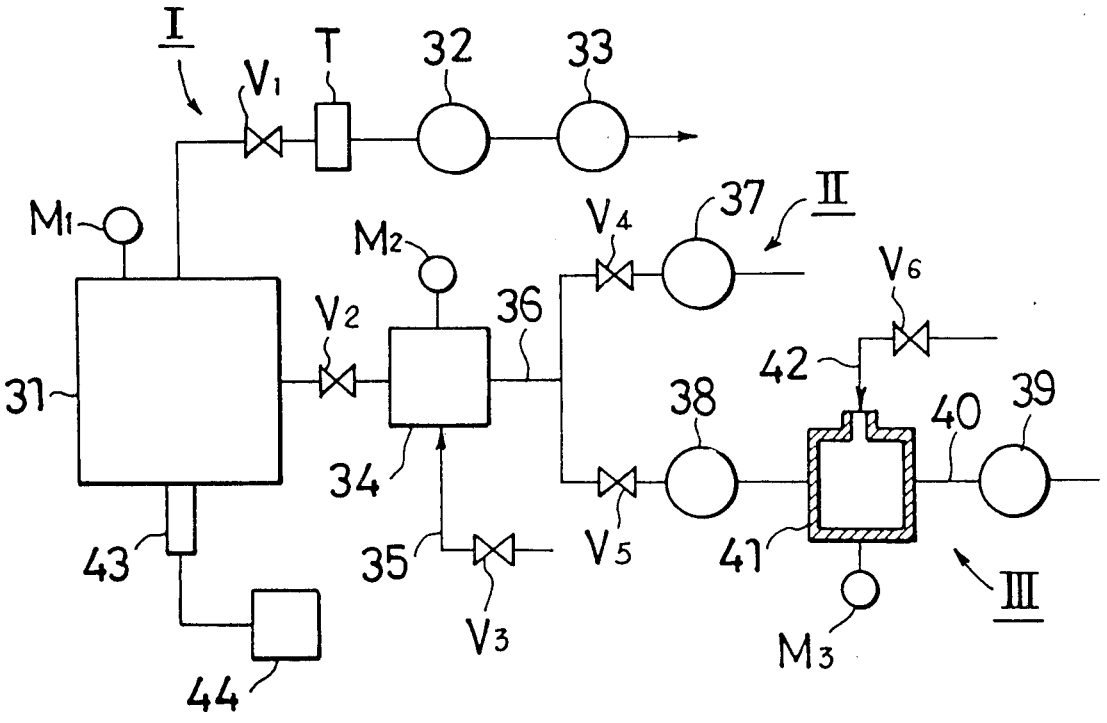
FIG. 5 illustrates an experimental vacuum system to compare the contamination in the atmosphere in a vacuum vessel of the high vacuum apparatus of the invention with the prior appratus.

Now the present invention will be described in detail referring to FIG. 5 which illustrates an experimental vacuum system to evaluate the contamination in the vacuum vessel 31 of the high vacuum system of the invention and the prior systems, and based on operating examples of the experimental system.

A prior high vacuum system I is composed of the vacuum vessel 31 having a vacuum gauge $M_1$, an oil diffusion pump 32 and an oil rotary pump 33 connected in this sequence with the vacuum vessel, and a cold trap T which is interposed between the vacuum vessel and the diffusion pump together with a valve $V_1$.

A second prior high vacuum system II includes the vacuum vessel 31 and an auxiliary chamber 34 connected therewith through a valve $V_2$ to control the degree of vacuum in the vacuum vessel. To this end the controlling chamber has a nitrogen gas inlet 35 having a valve $V_3$ and a vacuum gauge $M_2$. The controlling chamber is connected downstream with an oil rotary pump 37 through a connecting pipe 36 having a valve $V_4$ thereon. Nitrogen gas is introduced into the controlling chamber with a flow rate which is controllable by the valve $V_3$ to maintain the vacuum vessel at a predetermined degree of vacuum.

A third high vacuum system III of the invention is composed of the vacuum vessel 31, the auxiliary chamber 34, a mechanical booster 38 connected therewith through the connecting pipe 36 having a valve $V_5$ mounted thereon, and an oil rotary pump 39 connected with the mechanical booster through the connecting pipe 40 with the interposition of a controlling chamber 41 therebetween which has a nitrogen gas inlet 42 having a controlling valve $V_6$ and a vacuum gauge $M_3$. The controlling chamber is provided with the system to introduce nitrogen gas thereinto through the gas inlet 42 with a flow rate controlled by the valve $V_6$ to maintain the suction side or the upstream side of the rotary pump at a degree of vacuum lower than the maximum degree of vacuum attainable of the rotary pump.

The vacuum vessel 31 is further connected with a mass filter 43 and a vacuum gas analyzer 44 to detect and determine the amount of oil vapor therein.

EXAMPLE 1

As shown in the Table, with the valve $V_1$ fully opened, the valve $V_2$ and valve $V_3$ both slightly opened to introduce nitrogen gas from the gas inlet 35 into the vacuum vessel 31 through the intermediate chamber 34, and the valves $V_4$ and $V_5$ closed, the vacuum system I was operated so as to maintain the vessel at a degree of vacuum of $3\times10^{-5}$ Torr by measuring the vacuum in the vessel with the gauge $M_1$.

Figure 6:
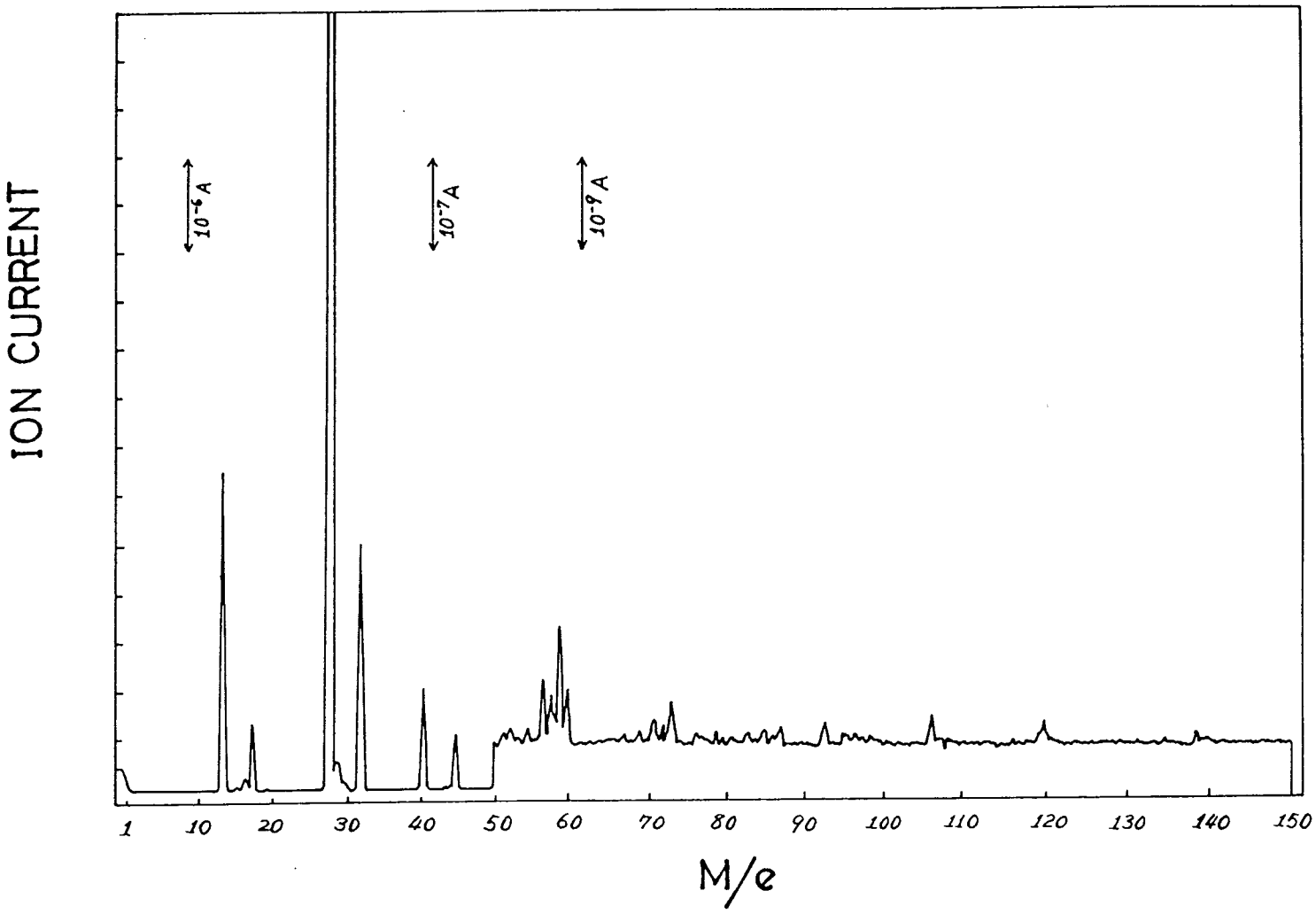
FIGS. 6 through 8 are mass spectra showing the gas composition of the atmosphere in the vacuum vessel of the vacuum apparatus of the prior arts.

The mass spectrum of the atmosphere in the vacuum vessel is shown in FIG. 6, in which the horizontal scale is the mass sweeping width, M/e, and the vertical scale is the ion current detected, and in which full scale sensitivities are $10^{-5}$ A, $10^{-6}$ A and $10^{-8}$ A when M/e is 1 to 35, 35 to 50, and 50 to 150, respectively. In the spectrum, the peaks at M/e smaller than 50 are due to nitrogen, water vapor, oxygen, argon and carbon dioxide, the peaks at M/e of 50 or more are due to oils or hydrocarbons. That is, the peaks at M/e of 50 to 60 are due to hydrocarbons of 4 carbons, the peaks at M/e of about 70 are due to hydrocarbons of 5 carbons, the peaks at M/e of about 80 are due to hydrocarbons of 6 carbons, the peaks at M/e of about 90 to 100 are due to hydrocarbons of 7 carbons, the peaks at M/e of about 106 are due to hydrocarbons of 8 carbons, and the peaks at M/e of about 120 are due to hydrocarbons of 9 carbons.

It will be understood that in the vacuum system I since the reversely diffusing oil vapor from the oil diffusion pump 32 is trapped by the cold trap T, substantially no oil contamination of the atmosphere in the vacuum vessel is found.

EXAMPLE 2

With the valves operated as shown in the Table, the vacuum system II was operated in the same manner as in Example 1 with the simultaneous operating of the system I to maintain the vacuum vessel at a degree of vacuum of $3.5\times10^{-5}$ Torr, since it was necessary to attain the degree of vacuum higher than $4\times10^{-4}$ Torr in the vacuum vessel to operate the mass filter, and it was also confirmed that no oil contamination of the vacuum atmosphere occurs by the operation of the vacuum system I as demonstrated in Example 1.

Figure 7:
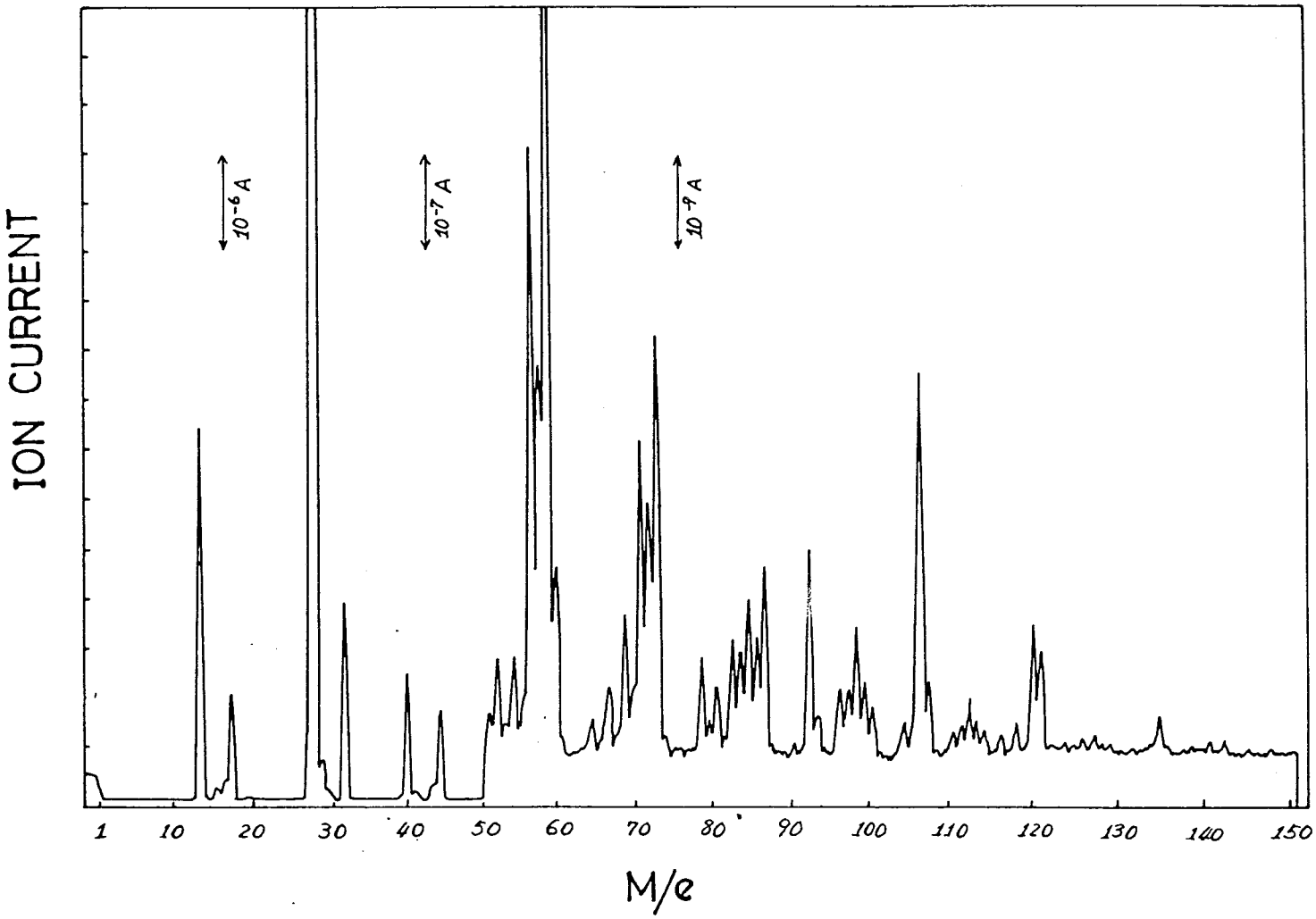

The mass spectrum of the atmosphere in the vessel is shown in FIG. 7. It is apparent that a remarkable oil contamination occurs according to the vacuum system II which uses an oil rotary pump.

EXAMPLE 3

With the valves operated as shown in Table, in particular the valve $V_6$ closed so as not to introduce nitrogen gas into the controlling chamber 41 through the gas inlet 42, the mechanical booster 38 and the rotary pump 39 were operated with the simultaneous operating of the vacuum system I while nitrogen gas was introduced from the gas inlet 35 into the vacuum vessel through the intermediate chamber 34 so as to maintain the vacuum vessel at a degree of vacuum of $3.5\times10^{-5}$ Torr. This vacuum system is the same as the system of the invention except that the introduction of nitrogen into the controlling chamber is omitted.

Figure 8:
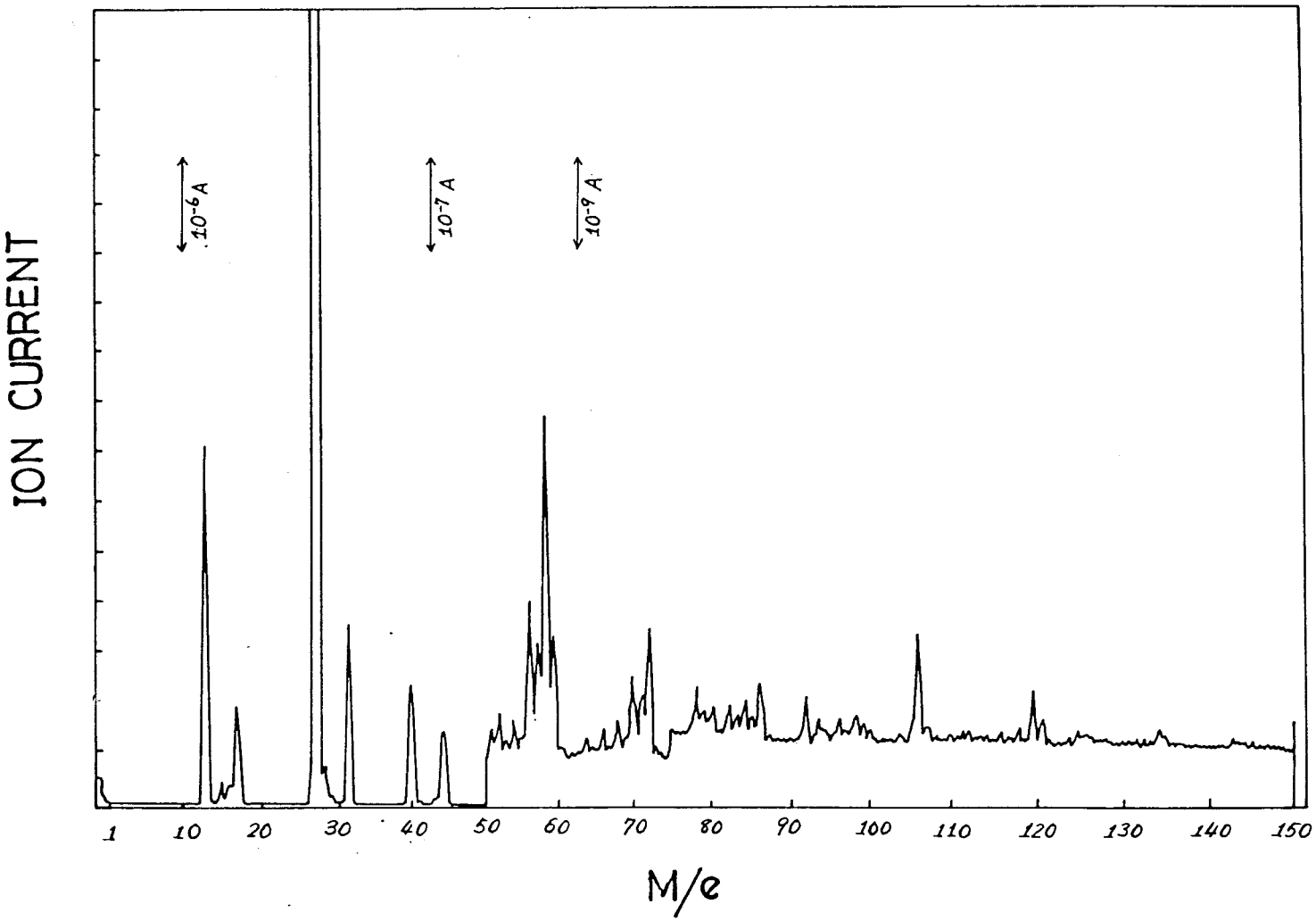

The mass spectrum of the atmosphere in the vessel is shown in FIG. 8. The oil contamination in the vacuum vessel is smaller than in the system II as aforesaid, however, much greater than in the system I.

EXAMPLE 4

With the valves operated as shown in Table, the vacuum system III was operated with the simultaneous operating of the system I while maintaining the vacuum vessel at a degree of vacuum of $3\times10^{-5}$ Torr as well as maintaining the suction side of the rotary pump at a degree of vacuum of 0.1 Torr by introducing a nitrogen gas into the controlling chamber 41 through the gas inlet 42 with a flow rate controlled by the valve $V_6$.

Figure 9:
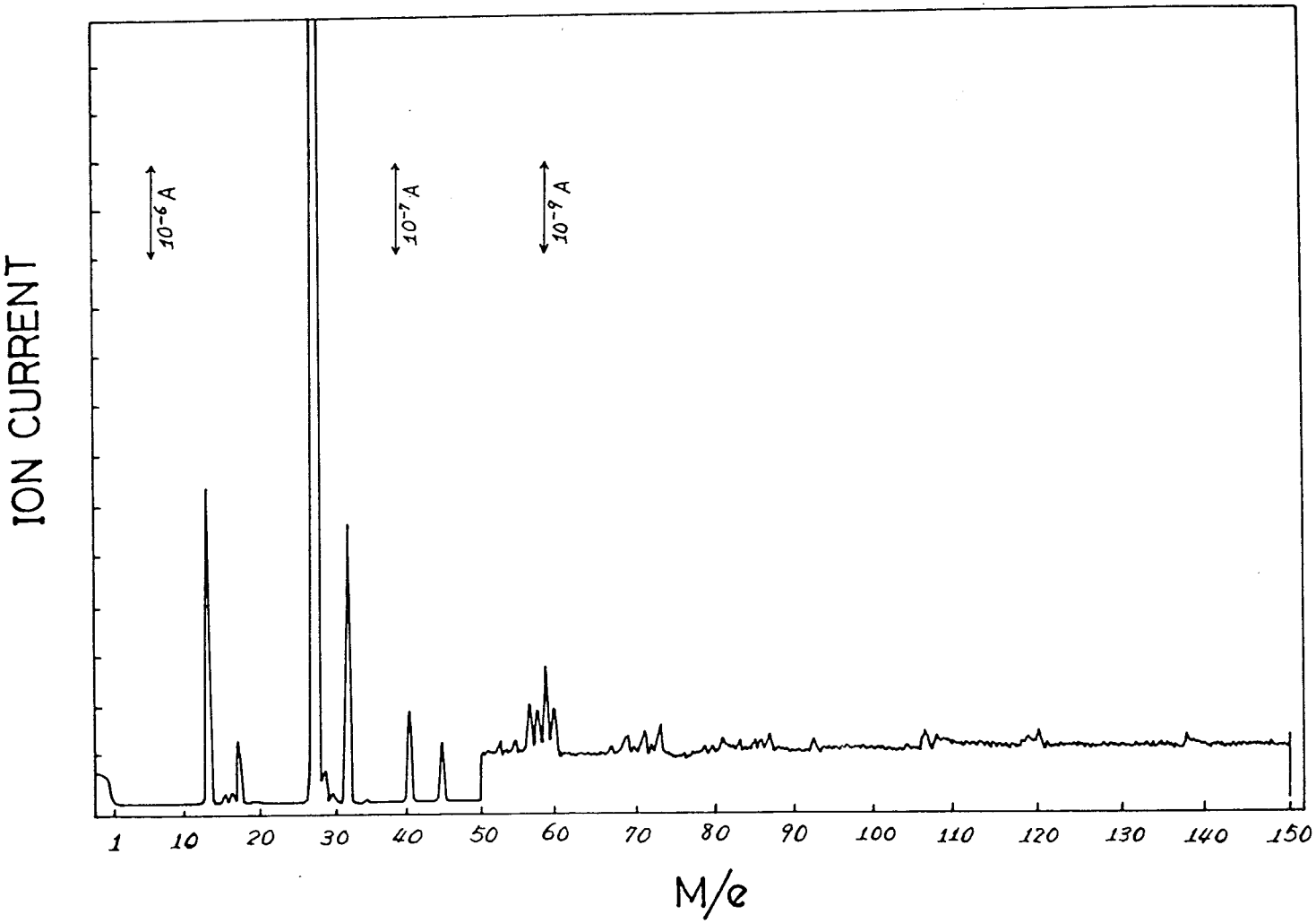
FIG. 9 is a mass spectrum showing the gas composition of the atmosphere in the vacuum vessel of the vacuum apparatus of the present invention.

The mass spectrum of the atmosphere in the vessel is shown in FIG. 9. It is apparent that the atmosphere in the vacuum vessel is substantially the same as that in the system I wherein the cold trap is used, and therefore substantially no oil contamination occurs in the vacuum system of the present invention.

| Examples | Systems | Valve Operation* | | | | | | Degree of Vacuum (Torr) | | |
|---|---|---|---|---|---|---|---|---|---|---|
| | | $V_1$ | $V_2$ | $V_3$ | $V_4$ | $V_5$ | $V_6$ | Intermediate Chamber | Controlling Chamber | Vacuum Vessel |
| 1 | I | FO | SO | SO | C | C | C | — | — | $3 \times 10^{-5}$ |
| 2 | II | FO | SO | SO | FO | C | C | $3.2 \times 10^{-2}$ | — | $3.5 \times 10^{-5}$ |
| 3 | III** | FO | SO | SO | C | FO | C | $3.2 \times 10^{-2}$ | — | $3.5 \times 10^{-5}$ |
| 4 | III | FO | SO | SO | C | FO | SO | $3 \times 10^{-2}$ | 0.1 | $3 \times 10^{-5}$ |

Notes:
*FO: Fully Opened;
SO: Slightly Opened;
C: Closed
**No nitrogen introduced into the controlling chamber.

What is claimed is:

1. A high vacuum apparatus which comprises:

a vacuum vessel, a mechanical booster pump which uses no vacuum pump oil connected to the vacuum vessel, an oil rotary pump connected to the mechanical booster to produce a vacuum in a connecting pipe which connects the mechanical booster to the oil rotary pump, and a gas inlet provided in the connecting pipe to introduce a gas into the suction side of the oil rotary pump so as to maintain the degree of vacuum in the suction side of the rotary pump sufficiently lower than the maximum degree of vacuum attainable by the rotary pump so as to substantially prevent reversible oil vapor diffusion, thereby attaining a high vacuum with substantially no oil contamination in the vacuum vessel.

2. The high vacuum apparatus as claimed in claim 1 which further includes a controlling chamber connected to the connecting pipe, the chamber having the gas inlet to introduce a gas into the suction side of the rotary pump, and a means for cooling the chamber.

3. A method of attaining high vacuum in a vacuum vessel with substantially no oil contamination, in a high vacuum apparatus which comprises:

a vacuum vessel, a mechanical booster pump which uses no vacuum pump oil connected to the vacuum vessel, an oil rotary pump connected to the mechanical booster to produce a vacuum in a connecting pipe which connects the mechanical booster to the oil rotary pump, and a gas inlet provided in the connecting pipe to introduce a gas into the suction side of the oil rotary pump, and wherein the degree of vacuum in the suction side of the rotary pump is maintained sufficiently lower than the maximum degree of vacuum attainable by the oil rotary pump to prevent reversible oil vapor diffusion, thereby attaining a high vacuum with substantially no oil contamination in the vacuum vessel.

4. The method as claimed in claim 3 in which the apparatus further includes a controlling chamber connected to the connecting pipe, the chamber having said gas inlet to introduce a gas into the suction side of the rotary pump, and a means for cooling the chamber.

5. The method according to claim 3 wherein the degree of vacuum in the suction side of the oil rotary pump is maintained at 1/10 to 1/100 of the maximum degree of vacuum attainable with the rotary pump.

* * * * *